US009030360B2

(12) United States Patent
Jerauld et al.

(10) Patent No.: US 9,030,360 B2
(45) Date of Patent: May 12, 2015

(54) ELECTROMAGNETIC BAND GAP STRUCTURE FOR ENHANCED SCANNING PERFORMANCE IN PHASED ARRAY APERTURES

(75) Inventors: Jason E. Jerauld, Tucson, AZ (US); David C. Cook, Oro Valley, AZ (US)

(73) Assignee: Raytheon Company, Waltham, MA (US)

( * ) Notice: Subject to any disclaimer, the term of this patent is extended or adjusted under 35 U.S.C. 154(b) by 377 days.

(21) Appl. No.: 13/558,860

(22) Filed: Jul. 26, 2012

(65) Prior Publication Data

US 2014/0028524 A1 Jan. 30, 2014

(51) Int. Cl.

| | |
|---|---|
| ***H01Q 1/38*** | (2006.01) |
| ***H01Q 1/52*** | (2006.01) |
| ***H01Q 15/00*** | (2006.01) |
| ***H01Q 17/00*** | (2006.01) |
| ***H01Q 21/06*** | (2006.01) |

(52) U.S. Cl.

CPC ..... *H01Q 1/52* (2013.01); *H01Q 15/006* (2013.01); *H01Q 17/00* (2013.01); *H01Q 21/065* (2013.01)

(58) Field of Classification Search

CPC ..... H01Q 1/52; H01Q 21/065; H01Q 17/00; H01Q 15/006

USPC ..... 343/700 MS, 909, 846, 848

See application file for complete search history.

(56) References Cited

U.S. PATENT DOCUMENTS

| | | | | |
|---|---|---|---|---|
| 5,563,614 | A * | 10/1996 | Alden et al. | 343/701 |
| 7,471,247 | B2 | 12/2008 | Säily et al. | |
| 7,773,033 | B2 | 8/2010 | Morton et al. | |
| 8,253,639 | B2 * | 8/2012 | Cohen | 343/753 |
| 8,514,036 | B2 * | 8/2013 | McKinzie, III | 333/251 |
| 2004/0008145 | A1 * | 1/2004 | Killen et al. | 343/753 |
| 2008/0111759 | A1 * | 5/2008 | Hjelmstad | 343/859 |
| 2012/0146881 | A1 * | 6/2012 | McKinzie, III | 343/909 |

OTHER PUBLICATIONS

Fu et al.; Elimination of Scan Blindness in Phased Array of Microstrip Patches using Electromagnetic Bandgap Materials; IEEE Antennas and Wireless Propagation Letters, vol. 3, Issue 1; Dec. 2004; pp. 63 to 65.

Iluz et al.; "Microstrip Antenna Phased Array with Electromagnetic Bandgap Substrate;" IEEE Transactions on Antennas and Propagation, vol. 52, No. 6; Jun. 2004; pp. 1446 to 1453.

Zhang et al.; "Scan Blindness Free Phased Array Design Using PBG Materials;" IEEE Transactions on Antennas and Propagation, vol. 52, No. 8; Aug. 2004; pp. 2000 to 2007.

* cited by examiner

*Primary Examiner* — Hoanganh Le

(74) *Attorney, Agent, or Firm* — Daly, Crowley, Mofford & Durkee, LLP

(57) ABSTRACT

Embodiments of a phased array antenna having a plurality of unit cells, each unit cell utilizing an improved electromagnetic band gap (EBG) structure and a lossy material in connection with the EBG element are disclosed. The lossy material reduces the undesired coupling between the antenna radiator and the EBG, thus providing enhanced scanning performance in the phased array aperture.

22 Claims, 4 Drawing Sheets

ELECTROMAGNETIC BAND GAP STRUCTURE FOR ENHANCED SCANNING PERFORMANCE IN PHASED ARRAY APERTURES

BACKGROUND

The present invention relates to phased arrays of antennas and, in particular, to methods and devices for achieving wide spatial scan performance over a broad range of frequency bands therewith.

The current method of achieving wide scan performance over broad frequency bandwidth in patch-based scanning apertures is to use substrates with low dielectric constant, such as foam. Unfortunately, these low dielectric constant substrates are often not mechanically or environmentally robust, and they do not allow for the extremely small processing tolerances required by the increasing operating frequency of phased array systems. More suitable substrate materials, which inherently have higher dielectric constants, limit the achievable bandwidth and scan volume of phased arrays due to induced surface waves that can cause the well-known scan blindness problem seen in the art.

Furthermore, phased array apertures comprised in part of dielectric substrates over a ground plane are subject to performance degradation due to surface waves. Metamaterial structures, such as electromagnetic band-gap structures (EBGs; referred to herein generally as metamaterials) have been proposed in the literature to be integrated into the aperture to suppress surface waves and therefore improve the scanning performance of the aperture. Such systems are described in, for example, U.S. Pat. No. 7,773,033 to Morton, et al., incorporated herein by reference in its entirety. However, interactions between the phased array antenna elements and the elements of the EBG structure can cause undesired modes in the aperture that also can degrade aperture performance. These interactions must be suppressed in order to take full advantage of the benefits of the EBG structure.

One known approach to suppressing these interactions is to lower the dielectric constant of the substrate covering the ground plane in order to remove the necessity of the EBG structure. However, advanced phased arrays benefit from higher dielectric constants so this approach is undesirable.

Scan blindness, and prior attempts at amelioration with metamaterial/EBG structures are described in, for example, the following references, each of which is hereby incorporated herein by reference in its entirety:

- Yunqi Fu and Naichang Yuan, "Elimination of Scan Blindness in Phased Array of Microstrip Patches Using Electromagnetic Bandgap Materials," IEEE Antennas and Wireless Propagation Letters, Vol. 3, 2004;
- Zeev Iluz, et al., "Microstrip Antenna Phased Array with Electromagnetic Bandgap Substrate," IEEE Trans. Antennas and Propagation, Vol. 52, No. 6, Jun. 2004; and
- Lijun Zhang, et al., "Scan Blindness Free Phased Array Design Using PBG Materials," IEEE Trans. Antennas and Propagation, Vol. 52, No. 8, Aug. 2004,

SUMMARY

In contrast to the above-described approaches, embodiments of the invention are directed to a phased array antenna having a plurality of unit cells, each unit cell utilizing an improved electromagnetic band gap (EBG) structure and a lossy material in connection with the EBG element. The lossy material reduces the undesired coupling between the antenna radiator and the EBG, thus providing enhanced scanning performance in the phased array aperture.

Electromagnetic interactions between the phased array antenna elements and the EBG elements induce electromagnetic modes of higher order than the desired mode. The concepts, systems, and techniques disclosed herein introduce a loss mechanism in the aperture sufficient to completely damp the higher order modes while only slightly affecting the desired mode. In some embodiments, this loss mechanism may be implemented by the introduction of a selectively-etched plane of resistive material on the top surface of the dielectric substrate in series with the EBG inductance and capacitance or, alternately in parallel with the capacitance. Other methods for introducing the loss are also disclosed.

Embodiments of the concepts, systems, and techniques herein disclosed allow the use of a wider variety of high dielectric constant substrates in phased array apertures without performance degradation due to either surface waves or higher order electromagnetic modes. Higher dielectric constant substrates, with their inherent high tolerance processing capability, enable the construction of millimeter-wave phased array antennas with broader scanning and frequency bandwidth than in arrays utilizing prior art dielectric substrates. Substrates constructed in accordance with the concepts, systems, and techniques presently disclosed may also include alternatives that are more mechanically and environmentally robust as well as those that can be processed with very small tolerances, further improving the state of the art in high performance phased array apertures.

This Summary is provided to introduce a selection of concepts in a simplified form that are further described below in the Detailed Description. This Summary is not intended to identify key features or essential features of the claimed subject matter, nor is it intended to be used to limit the scope of the claimed subject matter.

BRIEF DESCRIPTION OF THE DRAWINGS

The foregoing and other objects, features and advantages of the invention will be apparent from the following description of particular embodiments of the invention, as illustrated in the accompanying drawings in which like reference characters refer to the same parts throughout the different views. The drawings are not necessarily to scale, emphasis instead being placed upon illustrating the principles of the invention.

DETAILED DESCRIPTION

Figure 1:
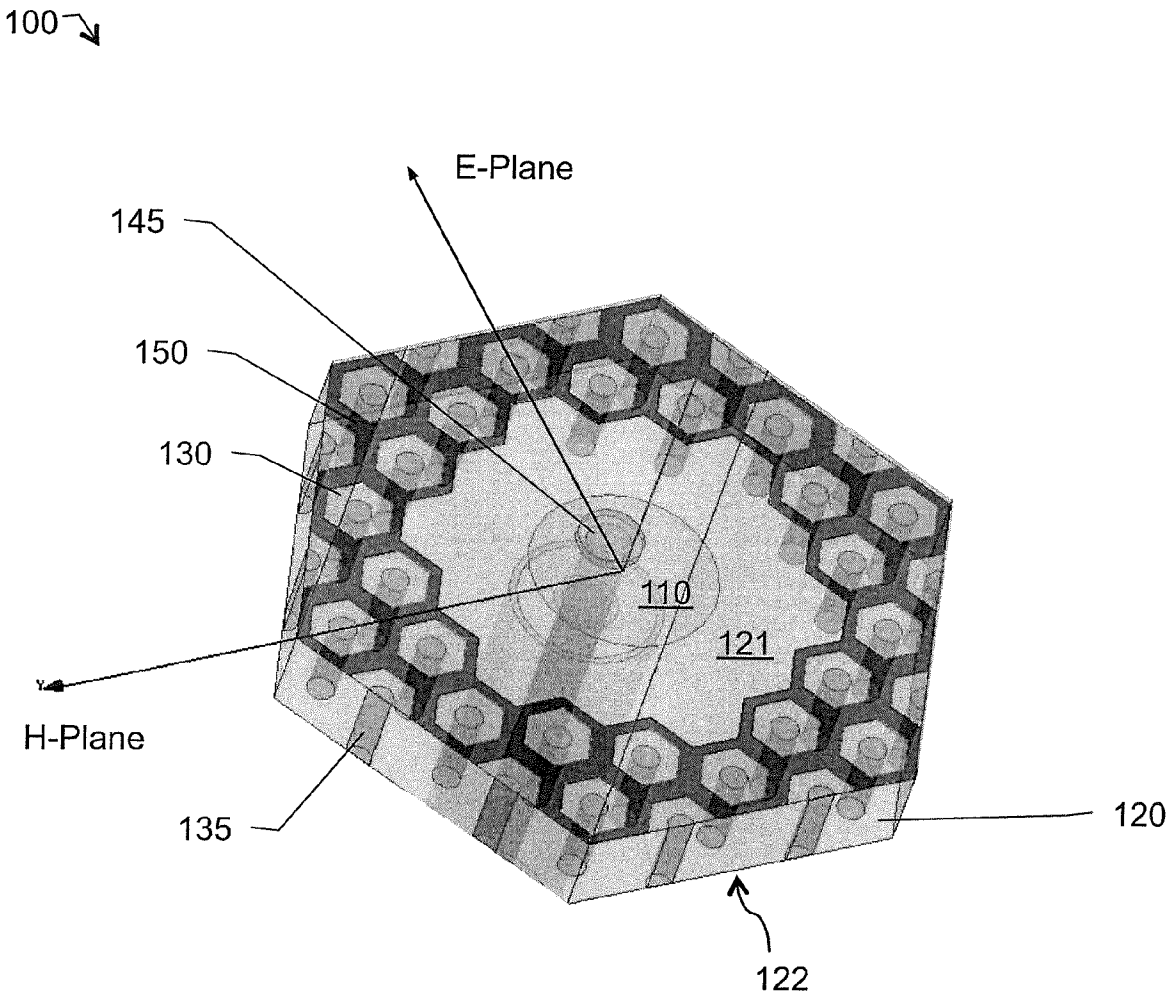
FIG. 1 is a perspective view of a unit cell for a phased array, constructed according to one embodiment of the present invention.

Referring now to the perspective view of FIG. 1, each unit cell 100 comprises a centrally-located patch antenna element 110 on an active (radiating or broadside) face 121 of a dielectric substrate 120 surrounded by a periodic array of metamaterial structures, such as (but not limited to) electromagnetic band gap (EBG) elements 130. Patch antenna 110 may be formed by any of a number of means commonly known and used in the art, such as (but not limited to) microstrip or other printed circuit patch antenna and the like. Each EBG element 130 contains a shorting pin 135 connecting the radiating face 121 of the dielectric substrate to the opposite, grounded face (or ground plane) 122.

The patch antenna element 110 is fed by an offset coaxial feed that enters the substantially planar dielectric substrate 120 from the opposite, grounded face 122 (i.e., the side opposite from the radiators). Feed 140 (shown for clarity in the side view of FIG. 4) may connect to patch antenna element 110 by means of a subminiature version "A" (SMA) connector pin 145 that extends through a via in substrate 120 (not shown). Further details of the feed are also shown and described in reference to FIG. 4.

In one exemplary embodiment, each unit cell 100 may be approximately hexagonal and bordered by a perimeter of closely-packed hexagonal EBG elements 130 as depicted in FIG. 1. Alternate geometries, including but not limited to square or rectangular unit cells with corresponding square or rectangular periodic EBG elements, will be appreciated as possible by those of ordinary skill in the relevant arts.

Although an electromagnetic band gap material is described, those skilled in the art will realize that metamaterial structures other than an EBG may be used. Accordingly, the concepts, systems, and techniques described herein are not limited to any particular type of metamaterial structures or electromagnetic bandgap material. Furthermore, although a patch antenna is described as the radiating element (or radiator) within the unit cell, those skilled in the art will realize that various types of radiators suitable for use in phased arrays, such as but without limitation dipoles, spirals, slots, or Vivaldi radiators, may be used. Accordingly, the concepts, systems, and techniques described herein are not limited to any particular type of radiating element within the unit cell.

In one exemplary embodiment, the radiator-side face of each EBG element is surrounded by a lossy material 150 that reduces the undesired coupling between the patch antenna element (also referred to herein as the radiator) and the EBG elements. In one exemplary embodiment, the lossy material 150 may be a resistor-conductor material (RCM) in the form of a foil, such as but not limited to OhmegaPly® RCM. (OhmegaPly is a registered trademark of Ohmega Technology, Inc. of Culver City, Calif.) Other RCMs known to those of ordinary skill in the art may also be used to provide the loss characteristics necessary to reduce or eliminate coupling for a specific application. The selection of a suitable RCM material for a given antenna array implementation, and the fabrication of an EBG-enhanced substrate incorporating the lossy RCM is well within the skill of one of ordinary skill in the relevant antenna design and construction arts.

Alternatively, the lossy material may be placed in the EBG circuit at a location other than the radiator-side face of each EBG element. For instance, a portion of the shorting pin 135 could be constructed of a lossy material. Furthermore, lossy material may be incorporated into the EBG structure between the shorting pin and the ground plane, without limitation. Further approaches to inserting the lossy material at other locations within the EBG circuit will be readily apparent without undue experimentation by those of ordinary skill in the relevant antenna design and construction arts. Accordingly, the details of such construction are not further discussed herein.

In one exemplary embodiment, an antenna array constructed according to the concepts, systems, and techniques presently disclosed has been shown to be capable of scanning out to 75 degrees with a 6% bandwidth and only slightly higher than a 2:1 voltage standing wave ratio (VSWR) using a substrate with dielectric constant of 6.5. This exemplary embodiment was designed and constructed with a 10 GHz center frequency ($\lambda_0$=1.1803") and a 6% target 2:1 VSWR bandwidth (9.7-10.3 GHz) over a greater than 60 degree scan volume. The substrate used was a Rogers 3006 substrate ($\epsilon_r$=6.5) with OhmegaPly resistor-conductor material (RCM) foil having 25 Ohm/Square resistance. In this exemplary embodiment, the substrate height=0.100" (equal to 0.0847*$\lambda_0$ at 10 GHz). A 0.6616" triangular lattice spacing was chosen to put the grating lobes just outside visible space at 90 degree scan at the highest frequency of 10.3 GHz.

In this demonstration array, an SMA connector was applied in the E-Plane with nail-head pin on the driven element. A 0.030" diameter plated thru hole via was provided for the EBG element shorting pin. The 0.025" gap between hexagonal EBG elements was filled with OhmegaPly RCM (25 Ohms/Square resistance) to incorporate loss necessary for operation without undesired modes. The OhmegaPly is exposed only on desired areas and etched away or covered by metal and thereby shorted everywhere else.

Figure 2:
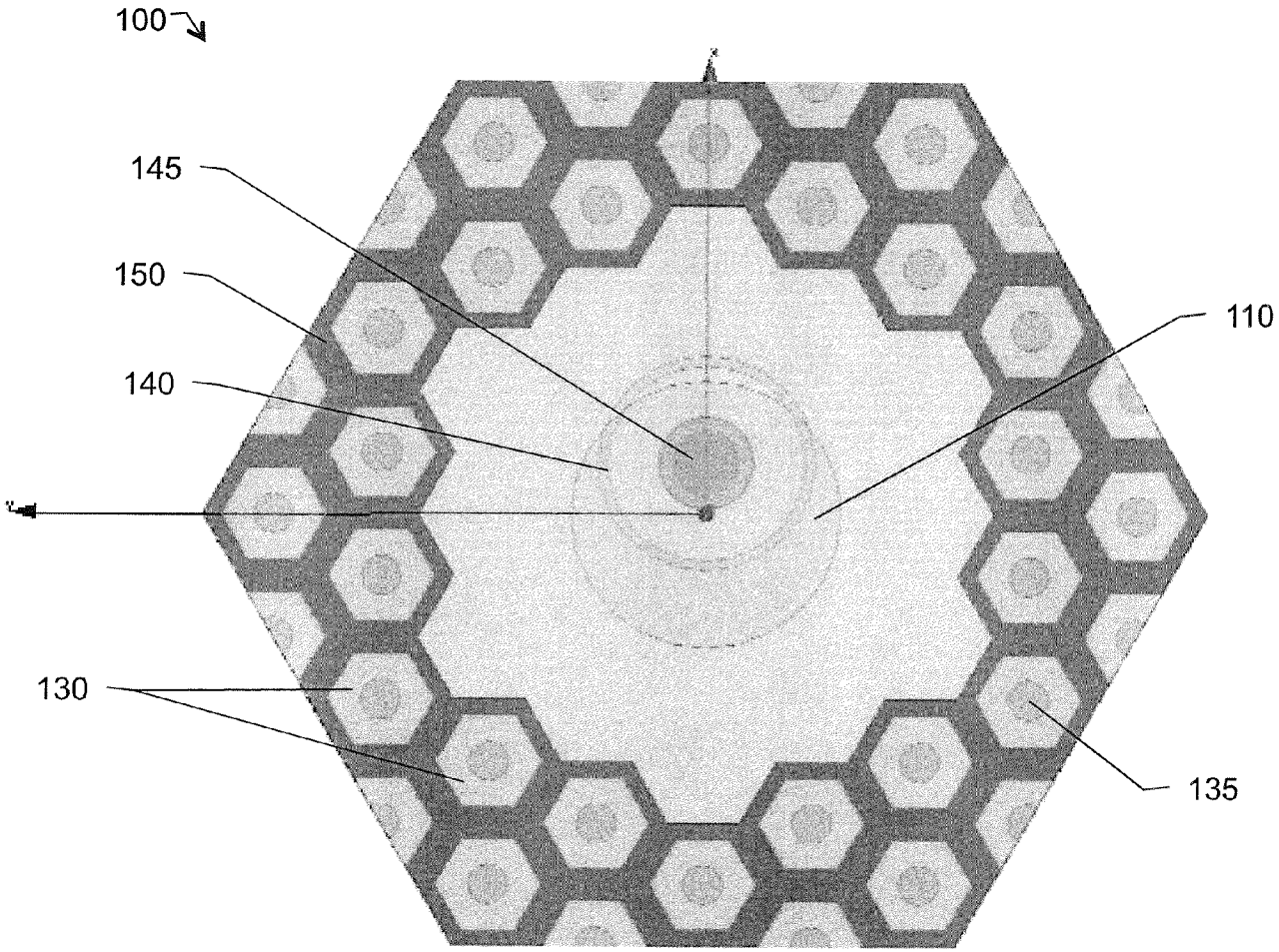
FIG. 2 is a plan view of a unit cell for a phased array, as seen from the radiating side, according to one embodiment of the present invention.

FIG. 2 is a plan view of unit cell 100, according to another embodiment of the present system. Although FIG. 2 appears to show partial EBG elements 130 around the perimeter, the requisite electromagnetic boundary conditions on the perimeter of the unit cell replicate the unit cell in such a way that no partial EBG elements exist, as is well known to those of ordinary skill in the relevant antenna design and construction. In this exemplary embodiment, both the unit cells and the EBG elements within each unit cell are arranged in an equilateral triangular lattice. Other lattices, such as rectangular and non-equilateral triangular are possible.

FIG. 2 also shows an offset feed arrangement of coaxial feed 140 and patch antenna element 110, whereby the center conductor of coaxial feed 140 (shown in outline), is located away from the geometric center of patch antenna element 110. One of ordinary skill in the art will appreciate that many feed arrangements are possible, depending at least in part on the operating parameters of the array and the type and size of the radiating element. Accordingly, the concepts, systems, and techniques described herein are not limited by the type or arrangement of the feed or the radiator used.

Figure 3:
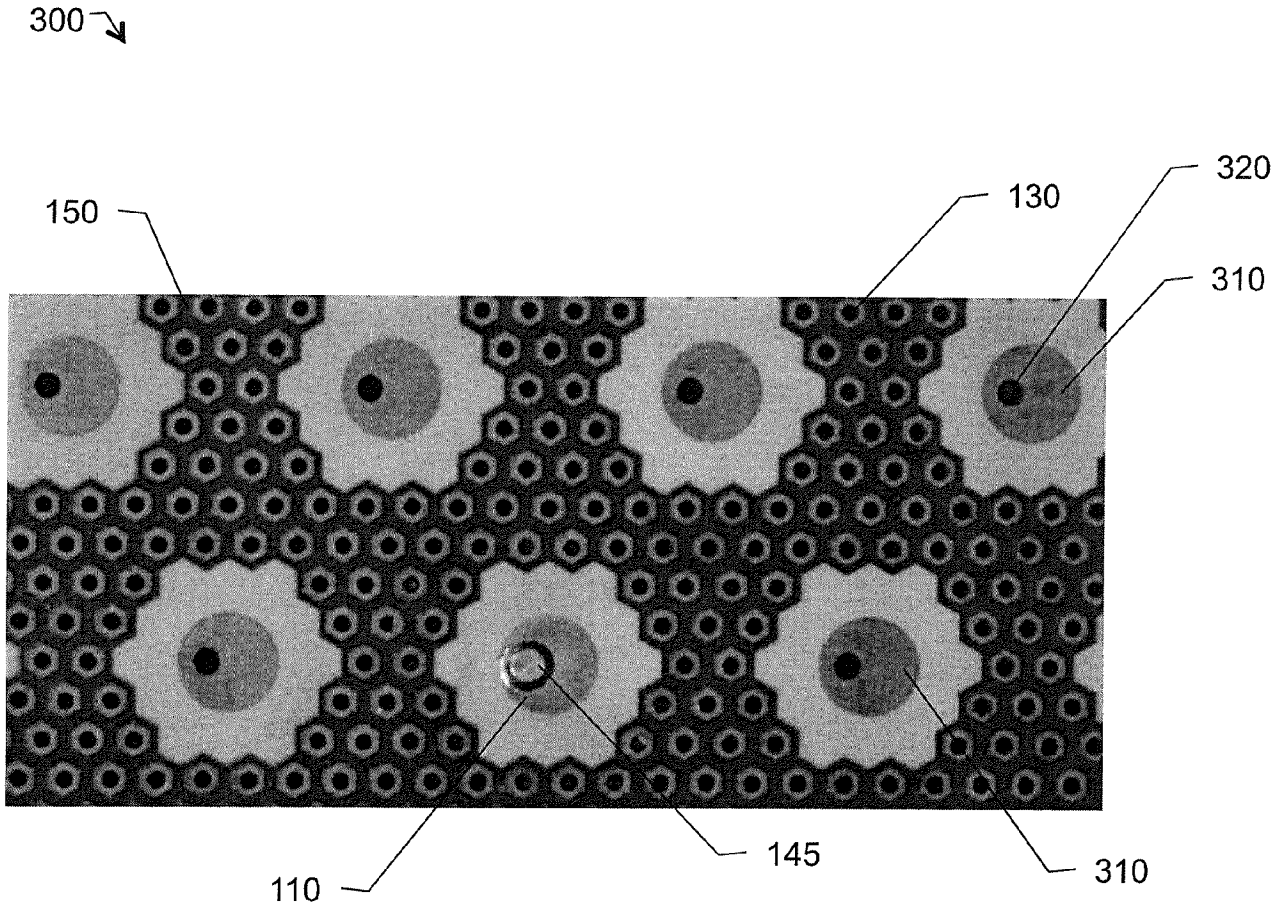
FIG. 3 illustrates a portion of an antenna array comprising a plurality of unit cells, according to one embodiment of the present invention.

FIG. 3 illustrates a portion of an antenna array 300 employing the unit cell described above. This array comprises of a driven patch antenna element surrounded by many hundreds of identical antenna elements, each terminated in its characteristic impedance (in this case, 50 Ohms). These many hundreds of passive antenna elements present to the driven element the environment seen in a large phased array antenna. From the measurement of the antenna pattern of the driven element in the array environment, the scanning performance of a large array of identical antenna elements can be determined, as is well known to those of ordinary skill in the relevant art of phased array antennas. Here, EBG elements 130 (each surrounded by an essentially contiguous deposit of RCM 150) completely surround both the driven patch antenna elements 110 and the loaded (i.e., not driven) patch antenna elements 310. It is to be noted that, in the illustration of FIG. 3, only one SMA pin 145 is shown connecting to driven patch antenna element 110. All of the other patch antenna elements 310 have only a metal plated via hole 320 that leads to a 50 Ohm load on the back side 122 of the structure and are not driven.

Figure 4:
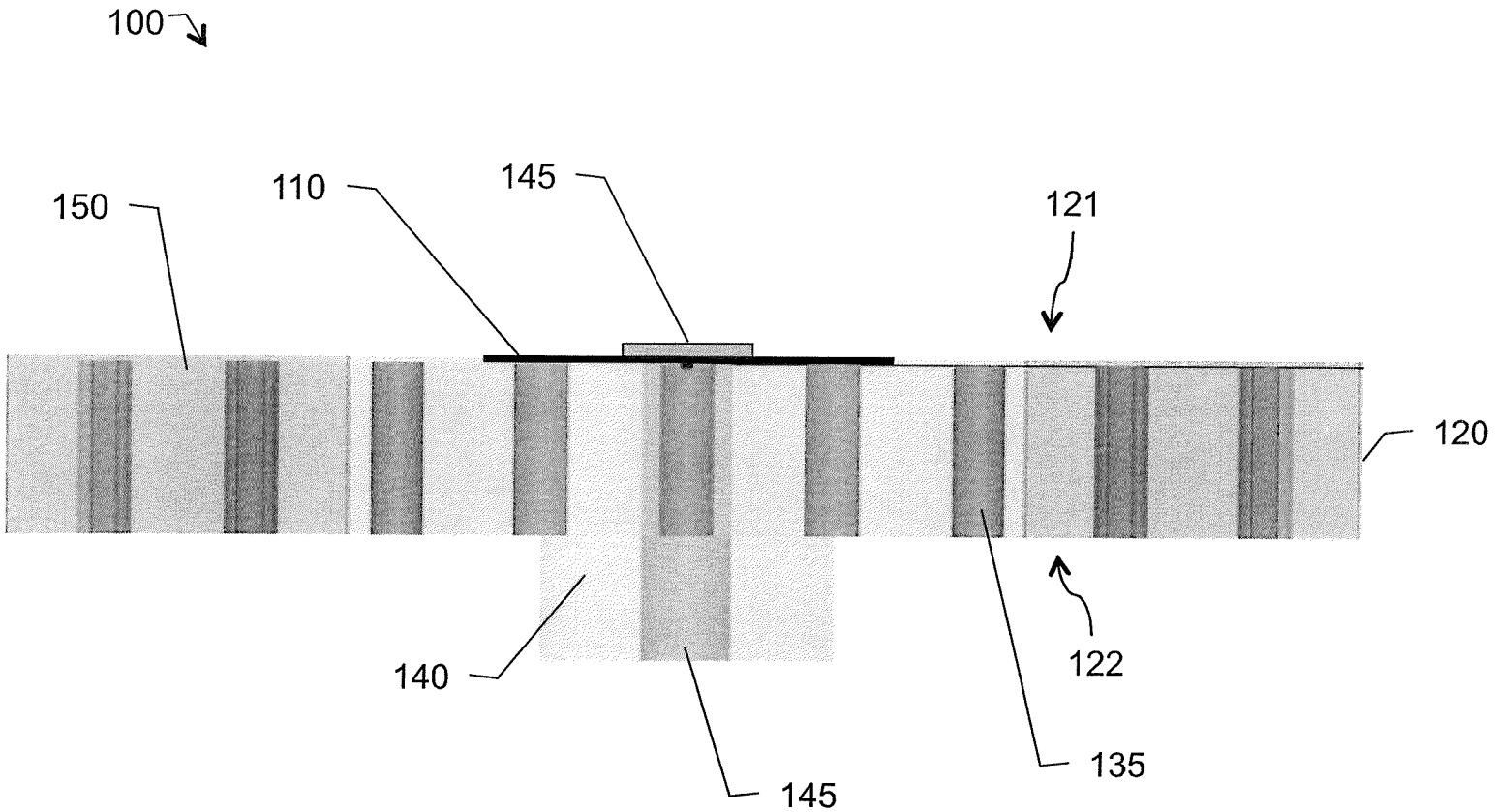
FIG. 4 is a section view of a unit cell for a phased array, according to one embodiment of the present invention.

FIG. 4 is a side view of unit cell 100, showing the orientation of coaxial feed 140 and SMA pin 145 relative to a driven patch antenna element 110 and substrate 120. Shorting pins 135 connect the radiating face 121 to the ground face 122 of each EBG; the EBGs themselves are not shown for clarity.

The concepts, systems, and techniques herein disclosed thus allow for the use of a wider variety of substrates for phased array antennas, including substrates that are environmentally robust as well as those that can be processed with very small tolerance.

While particular embodiments of the present invention have been shown and described, it will be apparent to those skilled in the art that various changes and modifications in form and details may be made therein without departing from the spirit and scope of the invention as defined by the following claims. Accordingly, the appended claims encompass within their scope all such changes and modifications.

We claim:

1. A phased array of antenna elements disposed on a substrate, comprising a plurality of unit cells, each said unit cell comprising:

an antenna element disposed on said substrate and substantially surrounded by a periodic arrangement of metamaterial elements;

a lossy material disposed on said substrate and forms a contiguous border around each said metamaterial element;

wherein said lossy material reduces undesired coupling between said antenna element and said periodic arrangement of metamaterial elements.

2. The phased array of claim 1, wherein said lossy material forms a portion of each said metamaterial element.

3. The phased array of claim 2, wherein:

said metamaterial elements each comprise a shorting pin and a ground plane;

said lousy material is disposed within said substrate; and said lossy material forms a contiguous connection between each said shorting pin and said ground plane.

4. The phased array of claim 1, wherein said unit cells are essentially hexagonal in shape and are arranged in a triangular lattice.

5. The phased array of claim 1, wherein said antenna element is a patch antenna.

6. The phased array of claim 1, wherein said periodic arrangement of metamaterial elements comprises a triangular lattice of essentially hexagonal metamaterial elements.

7. The phased array of claim 6, wherein said periodic arrangement of metamaterial elements is hexagonally close-packed.

8. The phased array of claim 1, wherein said antenna element is offset-coaxial-fed.

9. The phased array of claim 1, wherein said metamaterial elements each comprise a shorting pin.

10. The phased array of claim 9, wherein said shorting pin is centrally located within said metamaterial element.

11. The phased array of claim 1, wherein said metamaterial element comprises an electromagnetic baudgap structure.

12. An antenna element, comprising:

a radiator disposed on a substrate;

a periodic arrangement of metamaterial elements disposed around said radiator; and a lossy material disposed on said substrate and forms a contiguous border around each said metamaterial element.

13. The antenna element of claim 12, wherein said lossy material forms a portion of each said metamaterial element.

14. The antenna element of claim 12, wherein:

said metamaterial elements each comprise a shorting pin and a ground plane;

said lossy material is disposed within said substrate; and said lossy forms a contiguous connection between each said shorting pin and said ground plane.

15. The antenna element of claim 12, wherein said radiator is a patch antenna.

16. The antenna element of claim 12, wherein said antenna element is essentially hexagonal in shape.

17. The antenna element of claim 12, wherein said periodic arrangement of inetamaterial elements comprises a triangular lattice of essentially hexagonal metamaterial elements.

18. The antenna element of claim 17, wherein said periodic arrangement of metamatetial elements is hexagonally close-packed.

19. The antenna element of claim 12, wherein said radiator is offset-comial-fed.

20. The antenna element of claim 12, wherein said metamaterial elements each comprise a shorting pin.

21. The antenna element of claim 20, wherein said shorting pin is centrally located within said metamaterial element.

22. The antenna element of claim 12, wherein said metamaterial element comprises an electromagnetic bandgap structure.

* * * * *